US008474093B2

(12) United States Patent
Treitz

(10) Patent No.: US 8,474,093 B2
(45) Date of Patent: Jul. 2, 2013

(54) SUCTION APPLIANCE FOR CLEANING PURPOSES

(75) Inventor: Felix Treitz, Winnenden (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 13/310,993

(22) Filed: Dec. 5, 2011

(65) Prior Publication Data

US 2012/0137467 A1 Jun. 7, 2012

Related U.S. Application Data

(63) Continuation of application No. PCT/EP2009/058574, filed on Jul. 7, 2009.

(51) Int. Cl.
*A47L 9/02* (2006.01)

(52) U.S. Cl.
USPC ..... 15/352; 55/283; 55/302

(58) Field of Classification Search
USPC ..... 15/352; 55/283, 302
IPC ..... A47I 9/02
See application file for complete search history.

(56) References Cited

U.S. PATENT DOCUMENTS

| | | | |
|---|---|---|---|
| 2,591,567 | A | 4/1952 | Lofgren et al. |
| 3,325,979 | A | 6/1967 | Smith |
| 3,363,764 | A | 1/1968 | Whitaker |
| 3,396,516 | A | 8/1968 | Ballard |
| 3,431,709 | A | 3/1969 | Kawanami |
| 3,498,030 | A | 3/1970 | Wilki |
| 3,509,394 | A | 4/1970 | Heidtmann |
| 3,536,094 | A | 10/1970 | Manley, Jr. |
| 3,731,465 | A | 5/1973 | Ohira et al. |
| 3,748,836 | A | 7/1973 | Bachle |
| 3,792,569 | A | 2/1974 | Carlson et al. |
| 3,868,237 | A | 2/1975 | Berz |
| 3,945,390 | A | 3/1976 | Huber |
| 3,951,623 | A | 4/1976 | Furstenberg |
| 3,994,067 | A | 11/1976 | Hazzard et al. |
| 4,033,732 | A | 7/1977 | Axelsson et al. |
| 4,124,915 | A | 11/1978 | Schlicher |
| 4,124,916 | A | 11/1978 | Fromknecht |
| 4,171,208 | A | 10/1979 | Lowder |
| 4,277,265 | A | 7/1981 | Leinfelt |
| 4,329,161 | A | 5/1982 | Osborn |

(Continued)

FOREIGN PATENT DOCUMENTS

| | | |
|---|---|---|
| DE | 210 658 | 6/1909 |
| DE | 276953 | 7/1914 |

(Continued)

*Primary Examiner* — David Redding
(74) *Attorney, Agent, or Firm* — Lipsitz & McAllister, LLC

(57) ABSTRACT

Suction appliance for cleaning purposes, comprising a dirt collecting container with a suction outlet on which a filter is held, a suction unit for acting upon the dirt collecting container with negative pressure, a suction chamber between the suction unit and the filter with an external air inlet, via which external air can flow into the suction chamber to act upon the filter on the clean-space side, a valve device with a valve seat forming the external air inlet, a movable valve body to seal and release the valve seat, and an actuating member to cause the valve body to be transferred from a closed position to an open position. The appliance can comprise an energy storage device, to which energy to be stored can be supplied by actuating the actuating member. Stored energy can be released for transferring the valve body from the closed position to the open position.

24 Claims, 7 Drawing Sheets

U.S. PATENT DOCUMENTS

| | | | |
|---|---|---|---|
| RE31,417 | E | 10/1983 | Huber |
| 4,482,129 | A | 11/1984 | Baker et al. |
| 4,581,135 | A | 4/1986 | Gerulis |
| 4,719,662 | A | 1/1988 | Horak et al. |
| 4,733,326 | A | 3/1988 | Harsch et al. |
| 4,921,510 | A | 5/1990 | Plooy |
| 5,002,594 | A | 3/1991 | Merritt |
| 5,178,652 | A | 1/1993 | Hüttlin |
| 5,217,509 | A | 6/1993 | Jansen |
| 5,246,205 | A | 9/1993 | Gillingham et al. |
| 5,322,534 | A | 6/1994 | Kaiser |
| 5,368,060 | A | 11/1994 | Worrall et al. |
| 5,369,839 | A | 12/1994 | Wörwag |
| 5,511,583 | A | 4/1996 | Bassett |
| 5,882,180 | A | 3/1999 | Kawaguchi et al. |
| 5,951,746 | A | 9/1999 | Treitz et al. |
| 5,975,062 | A | 11/1999 | Bonse et al. |
| 6,406,505 | B1 | 6/2002 | Oh et al. |
| 6,440,191 | B1 | 8/2002 | Berfield et al. |
| 6,458,178 | B1 | 10/2002 | Dietz et al. |
| 6,517,325 | B2 | 2/2003 | Tsuru et al. |
| 6,640,385 | B2 | 11/2003 | Oh et al. |
| 6,782,583 | B2 | 8/2004 | Oh |
| 6,936,161 | B2 | 8/2005 | Wright et al. |
| 7,082,640 | B2 | 8/2006 | McCutchen |
| 7,340,797 | B2 | 3/2008 | Theiss, Jr. et al. |
| 7,647,672 | B2 | 1/2010 | Nam et al. |
| 7,861,367 | B2 | 1/2011 | Eckstein et al. |
| 7,867,304 | B2 | 1/2011 | Stewen et al. |
| 7,947,099 | B2 | 5/2011 | Valentini |
| 7,976,614 | B2 | 7/2011 | Eckstein et al. |
| 8,015,660 | B2 | 9/2011 | Bruntner |
| 2002/0066262 | A1 | 6/2002 | Oh |
| 2002/0088078 | A1 | 7/2002 | Oh et al. |
| 2002/0124729 | A1 | 9/2002 | Dudley |
| 2003/0041729 | A1 | 3/2003 | Finigan |
| 2003/0167590 | A1 | 9/2003 | Oh |
| 2005/0011036 | A1 | 1/2005 | McCutchen |
| 2005/0251953 | A1 | 11/2005 | Hackwell et al. |
| 2005/0254270 | A1 | 11/2005 | Melchert et al. |
| 2008/0086835 | A1 | 4/2008 | Stewen et al. |
| 2008/0092498 | A1 | 4/2008 | Stewen et al. |
| 2009/0000485 | A1 | 1/2009 | Valentini |
| 2009/0027823 | A1 | 1/2009 | Follic et al. |
| 2009/0106933 | A1 | 4/2009 | Bruntner |
| 2009/0205158 | A1 | 8/2009 | Eckstein et al. |
| 2009/0205159 | A1 | 8/2009 | Stewen et al. |
| 2009/0205491 | A1 | 8/2009 | Eckstein et al. |
| 2009/0205499 | A1 | 8/2009 | Eckstein et al. |

FOREIGN PATENT DOCUMENTS

| | | |
|---|---|---|
| DE | 338942 | 7/1921 |
| DE | 1 844 732 | 1/1962 |
| DE | 1 245 550 | 7/1967 |
| DE | 1 407 945 | 11/1968 |
| DE | 1 800 480 | 6/1970 |
| DE | 2 102 231 | 7/1971 |
| DE | 2 106 058 | 9/1971 |
| DE | 2 416 071 | 10/1974 |
| DE | 91 04 127 | 7/1991 |
| DE | 41 38 223 | 2/1993 |
| DE | 197 01 983 | 6/1998 |
| DE | 298 23 411 | 5/1999 |
| DE | 199 49 095 | 4/2001 |
| DE | 200 10 608 | 12/2001 |
| DE | 100 56 935 | 2/2002 |
| DE | 101 40 351 | 6/2002 |
| DE | 101 01 219 | 7/2002 |
| DE | 101 50 257 | 7/2002 |
| DE | 102 40 618 | 9/2003 |
| DE | 695 30 326 | 5/2004 |
| DE | 20 2004 012 911 | 11/2004 |
| DE | 10 2005 029 606 | 1/2006 |
| DE | 10 2004 056 076 | 5/2006 |
| DE | 10 2005 017 568 | 10/2006 |
| DE | 10 2005 017 702 | 10/2006 |
| DE | 10 2005 035 884 | 2/2007 |
| DE | 20 2007 015 242 | 1/2008 |
| EP | 0 289 987 | 11/1988 |
| EP | 0 197 036 | 3/1990 |
| EP | 0 955 003 | 11/1999 |
| EP | 0 873 075 | 2/2000 |
| EP | 1 166 705 | 1/2002 |
| EP | 1 340 446 | 9/2003 |
| EP | 1 656 872 | 5/2006 |
| EP | 1 743 562 | 1/2007 |
| EP | 1 913 857 | 4/2008 |
| EP | 1 997 415 | 12/2008 |
| GB | 956764 | 4/1964 |
| GB | 2 337 922 | 12/1999 |
| JP | 08038401 | 2/1996 |
| JP | 2002028107 | 1/2002 |
| JP | 2006181228 | 7/2006 |
| SU | 644513 | 1/1979 |
| WO | 85/02528 | 6/1985 |
| WO | 95/10972 | 4/1995 |
| WO | 95/27431 | 10/1995 |
| WO | 97/19630 | 6/1997 |
| WO | 01/74493 | 10/2001 |
| WO | 2004/100752 | 11/2004 |
| WO | 2005/006934 | 1/2005 |
| WO | 2006/108459 | 10/2006 |
| WO | 2008/014794 | 2/2008 |
| WO | 2008/014795 | 2/2008 |
| WO | 2008/014796 | 2/2008 |
| WO | 2008/014797 | 2/2008 |
| WO | 2008/014798 | 2/2008 |

SUCTION APPLIANCE FOR CLEANING PURPOSES

This application is a continuation of international application number PCT/EP2009/058574 filed on Jul. 7, 2009.

The present disclosure relates to the subject matter disclosed in international application number PCT/EP2009/058574 of Jul. 7, 2009, which is incorporated herein by reference in its entirety and for all purposes.

BACKGROUND OF THE INVENTION

The invention relates to a suction appliance for cleaning purposes, in particular, for cleaning floors, which comprises a dirt collecting container with a suction inlet and a suction outlet on which a filter is held, a suction unit for acting upon the dirt collecting container with negative pressure, a suction chamber between the suction unit and the filter with an external air inlet, via which external air can flow into the suction chamber to act upon the filter on the clean-space side, a valve device with a valve seat forming the external air inlet, and a valve body movable relative to the valve seat, the valve body in a closed position abutting sealingly on the valve seat and in an open position releasing the valve seat, and an actuating member, actuation of which causes the valve body to be transferred from the closed position to the open position.

In such a suction appliance, the external air inlet is closed by the valve device, i.e., the valve body assumes its closed position in which it abuts sealingly on the valve seat, during normal suction operation. The dirt collecting container can be acted upon with negative pressure via the suction chamber. This allows negative pressure to be generated at the suction inlet, in order to suck in suction material, for example, dirt or liquids, through it and deposit this in the dirt collecting container. During continuous suction operation, particles of dirt may accumulate on the filter and clog it. This results in a decrease in the negative pressure in the dirt collecting container and, consequently, in reduced suction power of the suction appliance.

To clean the filter, the user of a generic suction appliance can actuate the actuating member in order to transfer the valve body from the closed position to the open position in which it releases the valve seat. External air, for example, under atmospheric pressure, can flow into the suction chamber through the open external air inlet and act upon the filter to be cleaned on the clean-space side. Owing to the difference between the pressure of the external air and the negative pressure prevailing in the dirt collecting container, the filter to be cleaned is subjected to a pressure surge, as a result of which particles of dirt become detached from the filter and are deposited in the dirt collecting container. In addition, external air flows through the filter counter to the direction of flow prevailing during suction operation. This assists the cleaning of the filter. The valve body can then be transferred from the open position to the closed position again, and, therefore, the external air inlet closed, and normal suction operation can be continued.

Suction appliances of the kind mentioned at the outset have been found to work well in practice. However, it would be desirable if the suction result could be further increased.

The object of the present invention is to so develop a generic suction appliance that an improved suction result is obtained.

SUMMARY OF THE INVENTION

This object is accomplished, in accordance with the invention, with a suction appliance of the kind mentioned at the outset in that the suction appliance comprises an energy storage device to which energy that is to be stored can be supplied by actuating the actuating member, and from which stored energy can be released for transferring the valve body from the closed position to the open position.

The suction appliance in accordance with the invention comprises an energy storage device which, so to speak, is connected between the actuating member and the valve body. Energy can be supplied to the energy storage device by a user actuating the actuating member. The energy storage device can intermediately store the energy supplied to it and release it again to act upon the valve body with energy. By acting on the valve body with energy, an opening force can be applied to it. This force is opposed to the force—referred to hereinbelow as suction force—acting on the valve body owing to the negative pressure generated by the suction unit in the suction chamber. The valve body can be transferred from the closed position to the open position by the opening force. The advantage of use of the energy storage device is that energy can be supplied to it until the stored energy is sufficient to act upon the valve body with a force that exceeds the suction force. When such an amount of energy is stored in the energy storage device that such an opening force exceeding the suction force can act upon the valve body, the energy is released by the energy storage device within a short time. This results in the valve body being transferred very quickly from the closed position to the open position. Consequently, within a short time a large amount of external air flows through the external air inlet into the suction chamber and causes an abrupt increase in the pressure of the air in the suction chamber. This has the consequence that a strong pressure surge acting upon the filter on the clean-space side can form. The cleaning of the filter can, therefore, be carried out in a very effective way. Owing to the improved cleaning of the filter, an improved suction result can be obtained during normal suction operation.

The cleaning of the filter can be further improved if it consists of an easily cleanable, for example, nanocoated, material.

Energy stored by the energy storage device is preferably given off to the valve body to transfer it from the closed position to the open position. The valve body can thereby be acted upon with the energy and in this way an opening force can be applied to it to overcome the suction force and transfer the valve body very quickly from the closed position to the open position. The stored energy can be given off to the valve body by the energy storage device directly or indirectly, for example, by use of an energy transfer member "connected" between the energy storage device and the valve body.

It is expedient if energy can be supplied to the energy storage device by a user acting upon the actuating member with an actuating force. Acting upon the actuating member with an actuating force may, for example, result in movement of the actuating member. For this, the user must perform work on the actuating member by exerting the actuating force. This work can be given off by the actuating member to the energy storage device and can thus be supplied to it for storage.

It is advantageous if the actuating member is mounted so as to be movable on the suction appliance. This makes it possible to ensure a defined movement of the actuating member relative to the suction appliance, in particular, by acting upon it with an actuating force. Owing to the movable mounting on the suction appliance, it is thus possible to perform on the actuating member, in a defined manner, work which the actuating member can supply to the energy storage device as energy to be stored.

In particular, it is advantageous if the actuating member is mounted so as to be slidingly displaceable on the suction appliance. It has been found in practice that the performance of work on the actuating member can be brought about in a constructionally simple and user-friendly manner by displacement relative to the suction appliance.

In different developments of the suction appliance in accordance with the invention it may be provided that the actuating member is mounted so as to be pivotable or rotatable on the suction appliance. A combination of a slidable, a pivotable and/or a rotatable mounting is also possible.

The suction appliance preferably defines a guide for movable mounting of the actuating member. Movement of the actuating member relative to the suction appliance can be guided by means of the guide. Uniform movement and correct direction of movement of the actuating member can thereby be ensured in a simple way.

It is advantageous if the actuating member comprises an abutment element for abutment on the energy storage device at least when the actuating member is actuated. The actuating member can abut on the energy storage device via the abutment element. Work performed on the actuating member, for example, by acting upon the actuating member with an actuating force causing movement thereof can be given off to the energy storage device via the abutment element and stored by it. In a simple constructional design, the actuating member may comprise, for example, a ram having an abutment element in the form of a shoulder, on which the energy storage device can abut at least when the actuating member is actuated.

It may also be provided that there is "connected" between the actuating member and the energy storage device an energy transfer member, on which the actuating member abuts with an abutment element at least during actuation. In this way, the energy can be indirectly supplied to the energy storage device via the actuating member.

The energy storage device preferably comprises at least one elastically deformable energy storage member. This is a constructionally simple possibility of forming the energy storage device. When energy is supplied to the at least one energy storage member, it can undergo deformation, whereby it assumes an energy storing state. In this, it assumes, for example, a different outer shape than before the energy was supplied. Because the at least one energy storage member is elastically deformable, it can return from the energy storing state to the original state again, thereby releasing the energy meanwhile stored. The energy required to transfer the at least one energy storage member to the energy storing state is supplied to it by the actuating member, in particular, by acting upon the actuating member with an actuating force. The energy that has meanwhile been stored and is releasable upon return from the energy storing state to the original state serves to act upon the valve body in order to allow an opening force, which is opposed to the suction force, to act thereon.

The energy storage device can intermediately store mechanical energy in the manner described above. As an alternative or supplement, it may be provided that the energy storage device is configured to intermediately store electrical and/or chemical energy.

It is expedient if the at least one energy storage member is configured as a spring, for example, as helical spring, flexible spring, leg spring, spiral spring or torsion bar. This makes a simple constructional design of the suction appliance possible. The spring is elastically deformable. It may, for example, abut on an abutment element of the actuating member when it is actuated by a user. It is possible for the user to compress and thus elastically deform the spring by acting upon the actuating member. The work performed by the user on the actuating member is then stored in the form of potential energy by the spring. When the stored potential energy is large enough to be used to act upon the valve body with an opening force that is greater than the suction force, it can be released within a short time, with the spring again undergoing elastic deformation. The release of the potential energy of the spring within a short time results, as explained above, in a quick release of the valve seat by the valve body and causes a strong pressure surge to act upon the filter on the clean-space side.

The at least one energy storage member advantageously comprises an abutment element for abutment on the valve body at least when the valve body is transferred from the closed position to the open position. Energy stored in the energy storing state can be given off by the at least one energy storage member via the abutment element to the valve body abutting thereon. If the at least one energy storage member is configured as a spring, as described above, a winding of the spring, in particular, a helical spring, can, for example, form the abutment element.

As mentioned above, it may be provided that the stored energy is indirectly given off to the valve body. The energy storage member can also abut with the abutment element on an energy transfer member, which is "connected" between the energy storage member and the valve body and, for its part, comprises an abutment element for abutment on the valve body.

The energy storage device preferably forms an elastically deformable section of the valve body. This makes a simple construction of the suction appliance possible. The valve body can thus form a resilient, elastically deformable energy storage member on its elastically deformable section itself. By supplying energy, for example, by acting upon the actuating member with an actuating force, deformation of the valve body can be brought about at its deformable section and potential energy thus stored in the valve body itself. If the stored energy is sufficient to act upon the valve body with an opening force which exceeds the suction force, the deformable section of the valve body can undergo deformation again within a short time with the stored energy being released. Accordingly, the valve body can release the valve seat abruptly. In this way, a strong pressure surge acting upon the filter on the clean-space side can be generated. Such a valve body, at least a section of which is elastically deformable, is, for example, plate-shaped and consists, for example, of spring steel or a plastics material such as a thermosetting plastic or a thermoplast.

The valve body preferably comprises a first rigid section which in the closed position abuts sealingly on the valve seat, and a second section, which forms the elastically deformable section. A reliable sealing of the valve seat can be achieved by means of the rigid first section when the valve body is in the closed position. The elastically deformable second section can store energy by elastic deformation and then release it when an opening force exceeding the suction force is generatable in order to transfer the valve body from the closed position to the open position.

It is expedient if the valve body is mounted so as to be movable on the suction appliance. The movable mounting provides a constructionally simple possibility of transferring the valve body in a defined and reliable way from the closed position to the open position.

The suction appliance preferably defines a guide for movable mounting of the valve body. Movement of the valve body relative to the suction appliance can be guided by means of the guide. Correct direction of movement and uniform movement of the valve body can thereby be ensured in a technically simple way.

If the valve body is mounted so as to be movable on the suction appliance, it is, in particular, advantageous if the valve body is mounted so as to be pivotable on the suction appliance. It has been found in practice that transfer of the valve body from the closed position to the open position can thereby be effected in a technically particularly simple and defined way.

In different developments of the suction appliance in accordance with the invention, it may be provided that the valve body is slidably or rotatably mounted on the suction appliance. A combination of a slidable, a pivotable and/or a rotatable mounting is also possible.

It is advantageous if the valve body forms a lever with a first section forming a first lever arm which in the closed position abuts on the valve seat, and a second section forming a second lever arm which can be acted upon with the energy given off by the energy storage device. A technically simple construction of the suction appliance is made possible by the pivotable lever, which is advantageously mounted so as to be pivotable on the suction appliance. The first section forming the first lever arm is preferably of rigid construction so as to achieve a good sealing effect on the valve seat when the valve body is in the closed position. The second section forming the second lever arm may also be of rigid construction. At least during transfer of the valve body from the closed position to the open position, an energy storage member in the form of a spring and, in particular, a helical spring can abut on it in order to act upon it with stored energy. It is, however, also possible for the second section, as explained above, to be elastically deformable and to form an energy storage member.

The suction appliance preferably has a stop member associated with the valve body for limiting its range of movement during transfer from the closed position to the open position. The maximum range of movement of the valve body can be limited by the stop member. This ensures reliable operation of the valve device.

A simple construction of the valve device is made possible by at least a section of the valve body being plate-shaped. In particular, the valve body may be plate-shaped in a section that abuts on the valve seat in the closed position, in order to achieve a good sealing effect at the valve seat in the closed position. If the energy storage device, as mentioned above, forms an elastically deformable section of the valve body, with a plate-shaped valve body it has proven advantageous in practice for the valve body to be made of spring steel or a plastics material, in particular, of a thermoplast or a thermosetting plastic.

It is expedient if the valve seat forms an arched sealing surface. An arched sealing surface, in particular with a valve body, at least a section of which is plate-shaped, ensures that when the valve body is acted upon with the energy releasable by the energy storage device, the valve seat can be released uniformly. For example, the sealing surface, in relation to an at least partially plate-shaped valve body, may be of concave configuration.

In a construction corresponding to the above-described development of the suction appliance in accordance with the invention, it may be provided that a section of the valve body that abuts on the valve seat in the closed position is of arched configuration. In particular, in relation to the valve seat, it may be convexly curved. The above-described advantage is thus also achievable.

A constructionally simple design of the valve device is achievable by the valve body being configured as a single piece. In particular, the valve body may be made in a single piece of a plastics material, for example, a thermoplast or a thermosetting plastic. It is also possible for it to be formed by a single-piece spring steel element.

A sealing element is preferably arranged between the valve body and the valve seat when the valve body is in the closed position. An improved sealing is thereby achievable at the valve seat in the closed position. The sealing element may, in particular, take the form of a lip seal.

The suction appliance advantageously comprises a first restoring device for transferring the valve body from the open position to the closed position. After the filter has been cleaned, the valve body can be returned from the open position to the closed position again by the first restoring device in order to close the external air inlet. Normal suction operation can then be resumed.

It is expedient if the suction appliance comprises a second restoring device for transferring the actuating member from an actuating position in which energy can be supplied to the energy storage device to a position of rest in which no energy can be supplied to the energy storage device. The second restoring device can ensure that during or after actuation of the actuating member by a user, it does not remain in the actuated position. Rather, it is transferred to a position of rest. In order to clean the filter again, the actuating member assuming the position of rest can be actuated again by the user.

It may be provided that the suction appliance is configured as vacuum cleaner. This typically comprises a suction hose which is connectable to the suction inlet. For example, a floor nozzle or a machining tool, for example, a drilling, milling or sawing unit, can be connected to the free end of the suction hose facing away from the vacuum cleaner.

Alternatively, it may be provided that the suction appliance is configured as vacuum sweeper.

The following description of preferred embodiments of the invention serves for a more detailed explanation of the invention in conjunction with the drawings.

DETAILED DESCRIPTION OF THE INVENTION

Figure 1:
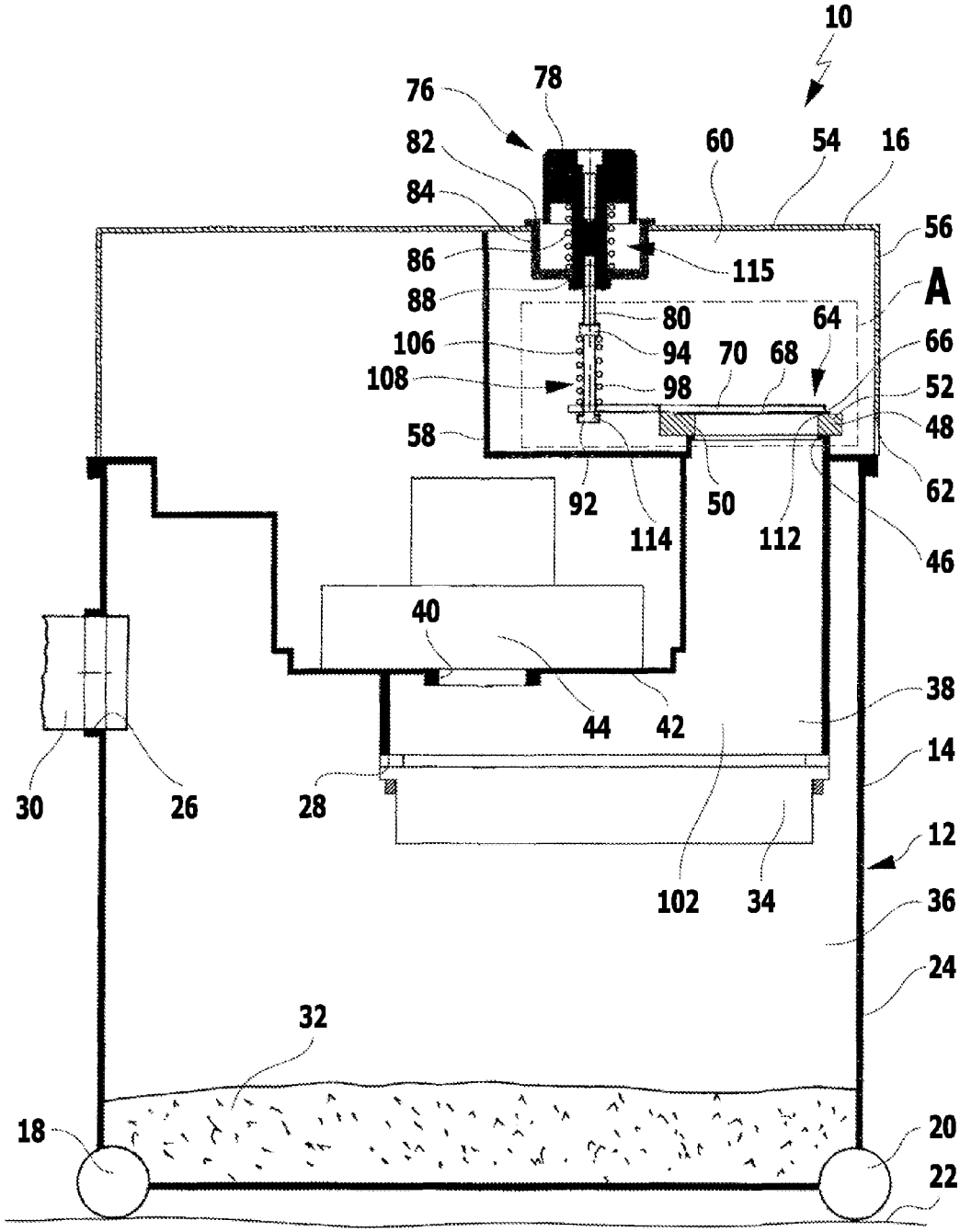
FIG. 1 shows a diagrammatic sectional view of a first preferred embodiment of a suction appliance in accordance with the invention with a valve body in a closed position.

A first preferred embodiment of a suction appliance in accordance with the invention takes the form of a vacuum cleaner, which is represented in a diagrammatic sectional view in FIG. 1 and is denoted by reference numeral 10 therein. The vacuum cleaner 10 comprises a housing 12 with a lower housing part 14 and an upper housing part 16 placed thereon. Rollers 18 and 20 which may serve to move the vacuum cleaner 10 on a set-down surface 22 are held on the lower housing part 14.

The lower housing part 14 is configured as a hollow body and forms a dirt collecting container 24 of the vacuum cleaner 10 with a suction inlet 26 and a suction outlet 28. Detachably connected to the suction inlet 26 is a suction hose 30, to whose free end, not shown in the drawings, which faces away from the dirt collecting container 24, a suction tool can be connected in a manner which is known and, therefore, not explained in further detail. The suction tool may, for example, be a floor nozzle or a machining tool such as a drilling, sawing or milling unit. By acting upon the dirt collecting container 24 with negative pressure in the manner described hereinbelow, suction material 32, for example, dirt or liquids can be sucked in through the suction hose 30 by the vacuum cleaner 10 and deposited in the dirt collecting container 24.

Held at the suction outlet 28 is a filter 34, which divides the hollow space defined by the lower housing part 14 into a first spatial area 36 and a second spatial area 38 which in sectional representation is L-shaped. The first spatial area 36 is that area of the hollow space defined by the lower housing part 14 in which the suction material 32 is deposited. The second spatial area 38 is arranged above the filter 34. The filter 34 may, for example, be a flat pleat filter made of a paper or polyester material. For improved cleaning, the filter may have a nano-coating.

A suction unit 44 is held in a manner, which is known and, therefore, not explained in further detail, between the lower housing part 14 and the upper housing part 16 on the vacuum cleaner 10 above a first through-opening 40, which is formed in a step-shaped cover wall 42 of the lower housing part 14, which delimits the second spatial area 38 on the upper side.

A second through-opening 46 of the cover wall 42 has a border, on the upper side of which a frame-shaped abutment member 48 is placed, only two segments 50 and 52 of which are to be seen in the drawings on account of the sectional representation. The segments 50 and 52 form part of the frame of the abutment member 48.

The upper housing part 16 is formed as a cover placed on the lower housing part 14, with a cover wall 54, a rear wall 56 and an angled intermediate wall 58. Formed between the cover wall 54, the rear wall 56, the intermediate wall 58 and the cover wall 42 of the lower housing part 14 is a space referred to hereinbelow as external air space 60. Air from the atmosphere, so-called external air, can enter the external air space 60 via an inlet opening 62 formed in the rear wall 56. Through the frame-shaped abutment member 48 and the second through-opening 46, external air can also enter the second spatial area 38, provided it is not closed by a valve device 64 of the vacuum cleaner 10.

Figure 2A:
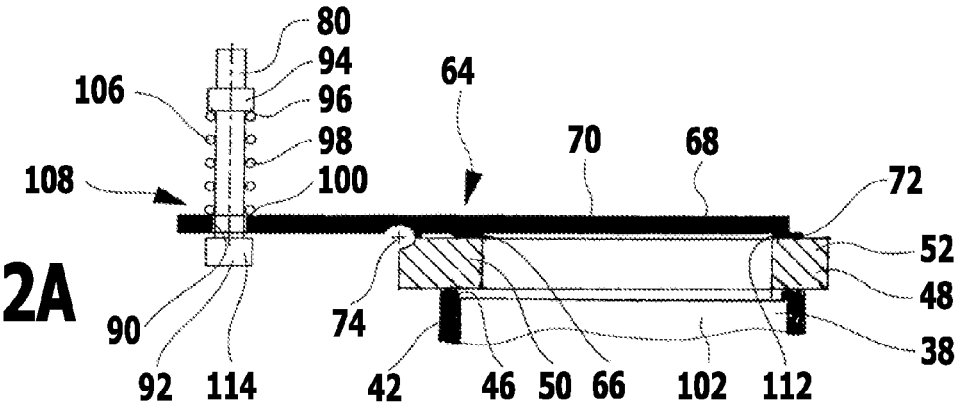
FIG. 2A shows an enlarged representation of detail A in FIG. 1.
Figure 2B:
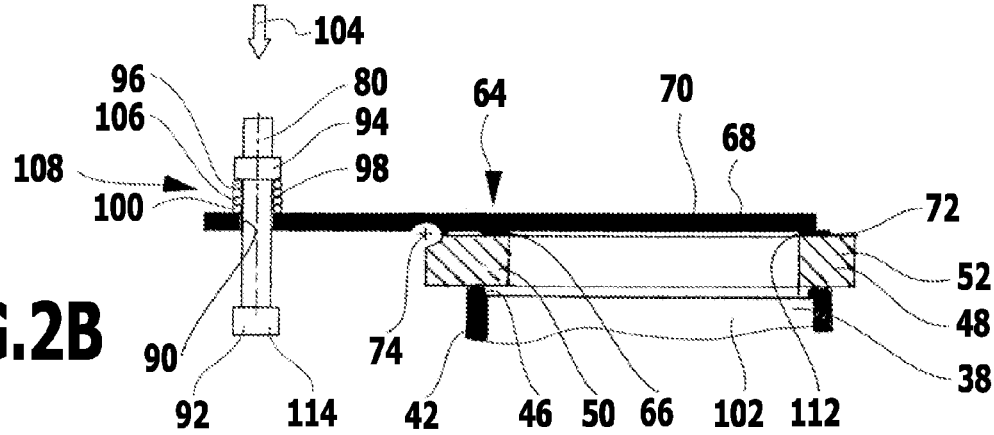
FIG. 2B shows a representation corresponding to FIG. 2A when an actuating member of the suction appliance is actuated to transfer the valve body from the closed position to an open position.
Figure 2C:
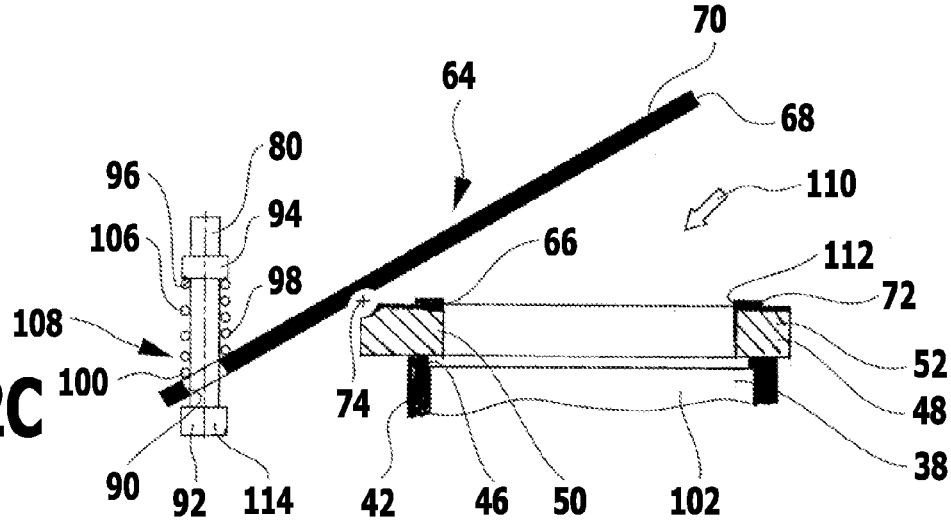
FIG. 2C shows a representation corresponding to FIG. 2A in which the valve body assumes the open position.
Figure 3A:
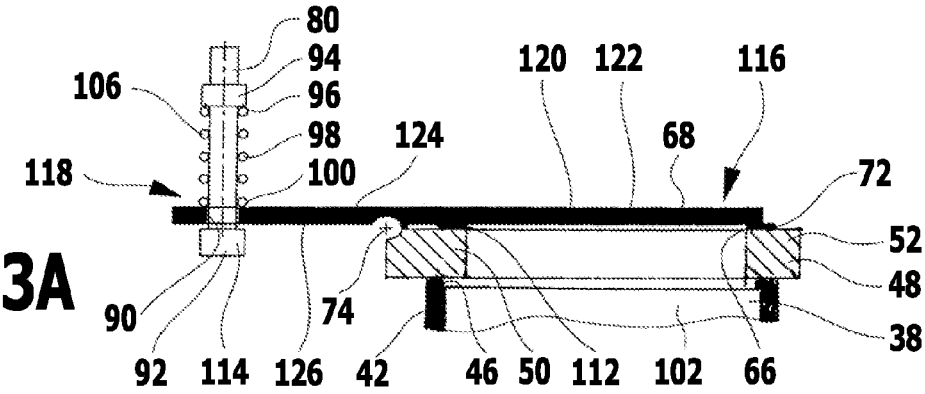
FIG. 3A shows a representation similar to FIG. 2A in a first variant of the suction appliance from FIG. 1.
Figure 3B:
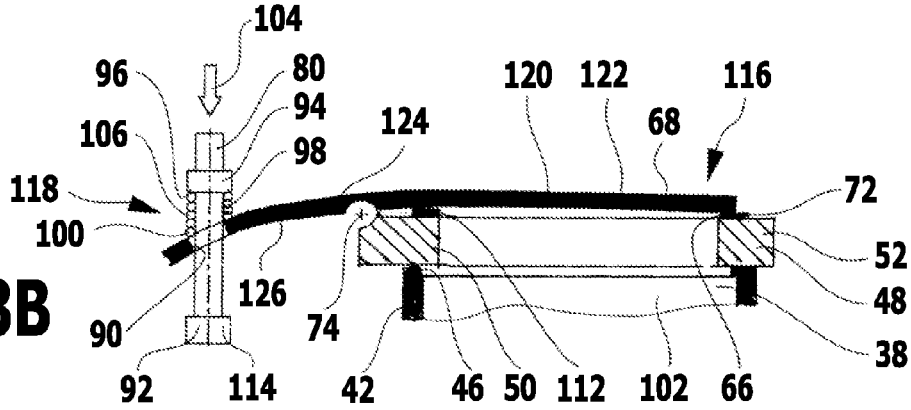
FIG. 3B shows a representation similar to FIG. 2B in the variant of the suction appliance shown in FIG. 3A.
Figure 3C:
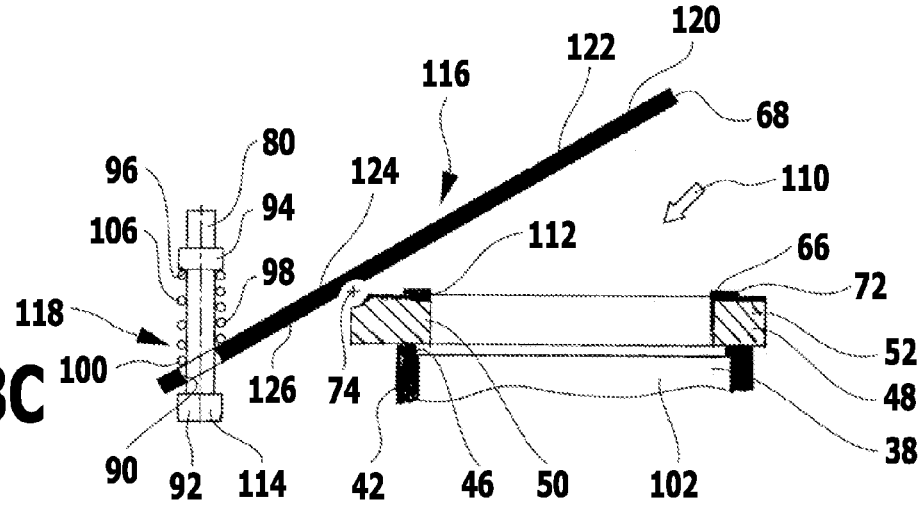
FIG. 3C shows a representation similar to FIG. 2C in the variant of the suction appliance shown in FIG. 3A.

The valve device 64 comprises a valve seat 66 formed on the surface of the abutment member 48 and a valve body 68 in the form of a valve plate 70. The valve plate 70 can abut sealingly on the valve seat 66 and in this way seal off the second spatial area 38 relative to the external air space 60. A particularly effective sealing is achieved by a circumferential sealing element 72, in particular, in the form of a lip seal, being fixed to the upper side of the abutment member 48 (FIGS. 2A to 2C). A position of the valve plate 70, in which it abuts sealingly on the valve seat 66 is referred to as closed position of the valve plate 70.

The valve plate 70 is mounted on the vacuum cleaner 10 for pivotal movement about a horizontally extending axis 74, which is arranged at the side of the abutment member 48 that faces the center of the vacuum cleaner 10 and in the drawings extends perpendicularly to the drawing plane (FIG. 2A). In this way, the valve plate 70 forms a lever.

The vacuum cleaner 10 has a multipart actuating member 76 for pivoting the valve plate 70. It is mounted for sliding displacement on the vacuum cleaner 10 and comprises an actuating button 78 arranged on the cover wall 54, and a ram 80 fixed to the lower end of the actuating button 78 and arranged in the external air space 60. The actuating button 78 is supported upwards by a spring in the form of a helical spring 86 on a tub-shaped supporting part 84 inserted in a through-opening 82 of the cover wall 54. The actuating button 78 passes through a through-opening 88 on the underside of the tub-shaped supporting part 84.

The ram 80 passes through a through-opening 90 formed in the valve plate 70 at the end thereof which faces the center of the vacuum cleaner 10. A head 92 extending in the lateral direction beyond the border of the through-opening 90 is fixed to the end of the ram 80 below the valve plate 70. Above the valve plate 70, the ram 80 carries a ring 94 with a lower side, facing the valve plate 70, which forms an abutment element 96 for a spring in the form of a helical spring 98. The helical spring 98 abuts with its upper end on the abutment element 96 and thus on the ring 94 and itself forms at its lower end facing the valve plate 70 an abutment element 100, which abuts on the valve plate 70, thereby bordering on the through-opening 90 (FIGS. 2A to 2C).

During normal suction operation of the vacuum cleaner 10 shown in FIG. 1, the dirt collecting container 24 is acted upon with negative pressure by the suction unit 44 through the second spatial area 38 and the filter 34. For this reason, the second spatial area 38 is also referred to as suction chamber 102. The valve device 64 is closed, i.e., the valve plate 70 assumes its closed position in which it abuts sealingly on the valve seat 66. Owing to the negative pressure in the suction chamber 102, a suction force acting on the valve plate 70 causes it to abut sealingly on the valve seat 66. As a result, external air entering the external air chamber 60 via the inlet opening 62 cannot enter the suction chamber 102 through the abutment member 48 and the opening 46. As mentioned above, owing to the negative pressure in the dirt collecting container 24, suction material 32 can be sucked in through the suction hose 30 into the dirt collecting container 24 and deposited there.

During continuous suction operation and, in particular, with high ingress of dirt at the free end of the suction hose 30, particles of dirt can accumulate at the filter 34 and thereby impair passage of suction air through it. As a result, less suction air can be sucked out of the dirt collecting container 24 by the suction unit 44. This results in a rise in pressure in the dirt collecting container 24 and reduces the suction effect at the free end of the suction hose 30.

The following procedure can be used to clean the filter 34, i.e., to free it from particles of dirt adhering to it:

By acting upon the actuation member 76, in particular, its actuating button 78, with an actuating force directed towards the interior of the vacuum cleaner 10, the actuating member 76 mounted for sliding displacement on the vacuum cleaner 10 can be displaced relative thereto. In this way, work is performed on the ram 80, namely in that it is displaced by the actuating force along a path relative to the valve plate 70. The helical spring 98 abutting on the abutment element 76 formed by the ring 94, owing to it abutting with its lower end forming the abutment element 100 on the valve plate 70, is compressed by the work performed on the ram 80. This is shown in FIG. 2B, in which an arrow 104 symbolizes the actuating force exerted on the actuating member 76 and thus on the ram 80.

Work performed on the ram 80 owing to the actuating member 76 being acted upon with the actuating force is thus supplied to the helical spring 98. Starting from a relaxed state which the helical spring 98 assumes when the actuating member 76 is not acted upon by an actuating force (FIGS. 1 and 2A), the helical spring 98 is thus transferred to an energy storing state in which it stores energy supplied to it in the form of potential energy. The possibility of storing potential energy exists on account of the elastic deformability of the helical spring 98. Because it is capable of storing energy, it is also referred to as energy storage member 106. The energy storage member 106 forms an energy storage device 108 of the vacuum cleaner 10.

Compared to the valve plate 70 being acted upon with force directly by the ram 80, the so-to-speak "interposed" helical spring 98 has the advantage that it enables a considerably faster opening of the valve device 64. When the helical spring 98 assumes its energy storing state in which it is compressed, energy is intermediately stored until the intermediately stored energy is releasable again by the helical spring 98 to enable release of the valve seat 66. If the energy intermediately stored by the helical spring 98 is of such size that the valve plate 70 can thus be acted upon with an opening force that is opposed to the suction force, the helical spring 98 can release within a short time and, in particular, give off to the valve plate 70 the potential energy that has been intermediately stored. This results in an impact of force on the valve plate 70, which causes it to be abruptly pivoted about the axis 74 relative to the vacuum cleaner 10. In this way, the valve plate 70 releases the valve seat 66 and, in particular, is lifted off from it (FIG. 2C). This defines an open position of the valve plate 70. To limit the range of movement of the valve plate 70 on the vacuum cleaner 10, the head 92 acts as stop member 114 for the valve plate 70.

External air under atmospheric pressure located in the external air space 60 can enter the suction chamber 102 in a direction symbolized by an arrow 110 in FIG. 2C. For this reason, the valve seat 66 is also referred to as external air inlet 112. The inflowing external air results in a pressure difference between the air in the dirt collecting container 24 and the air in the suction chamber 102, so that the filter 34 is subjected to a pressure surge directed at the dirt collecting container 24. The pressure surge occurs abruptly owing to the rapid opening of the valve device 64 due to use of the helical spring 98, so that a particularly effective cleaning of the filter 34 can take place. Particles of dirt adhering to it become detached from it and are deposited together with the suction material 32 in the dirt collecting container 24.

An even more effective cleaning of the filter 34 can be achieved by the negative pressure in the dirt collecting container 24 being increased before acting upon the actuating member 76 with the actuating force. This can be done by, for example, the suction inlet 26 or the suction hose 30 being closed. The increased negative pressure in the dirt collecting container 24 results in a greater pressure difference between the air in the dirt collecting container 24 and the external air flowing into the suction chamber 102 and, therefore, in an even more intensive pressure surge acting upon the filter 34.

The acting upon the actuating member 76 with the actuating force results in a compression of the helical spring 86, which is supported on the actuating button 78 on the upper side and on the supporting part 84 on the lower side. When the actuating member 76 is no longer acted upon with an actuating force, the helical spring 86 relaxes, and the actuating member 76 returns to its position of rest shown in FIG. 1. For this reason, the helical spring 86 forms a restoring device 115 for the actuating member 76. In the position of rest, no more energy is supplied to the helical spring 98. The valve plate 70 returns from the open position to the closed position in which it abuts sealingly again on the valve seat, and normal suction operation can be continued.

In a variant of the vacuum cleaner 10, a valve device 116 is used instead of the valve device 64, and an energy storage device 118 instead of the energy storage device 108. In a representation corresponding to FIGS. 2A to 2C, FIGS. 3A to 3C show transfer of a valve plate 120 of the valve device 116 by a user acting upon the actuating member 76 with the actuating force.

In contrast to the valve plate 70, the valve plate 120 is not of completely rigid construction. Instead, it has a rigid first section 122, which is located at the end of the valve plate 120 that is arranged above the abutment member 48, so that in the closed position of the valve plate 120 it can abut sealingly on the valve seat 66. The valve plate 120 also has an elastically deformable second section 124 at its end that faces the ram 80.

When the actuating member 76 and thus the ram 80 are acted upon with the actuating force, the work performed on the ram 80 results not only in compression of the helical spring 98 but also in elastic deformation of the second section 124 of the valve plate 120. In this way, part of the energy in the form of work performed on the actuating member 76 is also stored in the valve plate 120 in the form of potential energy. This energy is supplied to the second section 124 by the abutment element 100 of the helical spring 98.

When, as described above, the potential energy stored by the helical spring 98 is released, the energy stored in the second section 124 of the valve plate 120 can also be released in order to pivot the valve plate 120 about the axis 74 and thus lift the first section 122 off from the valve seat 66. This also takes place, as described above, within a short time because the potential energy stored in the helical spring 98 and in the valve plate 120 is only released when the suction force acting on the valve plate 120 can thus be overcome. The above-described advantage of an abrupt opening of the external air inlet 112 and of an intensive pressure surge acting upon the filter 34 can thereby also be achieved.

Because the valve plate 120 is partly elastically deformable, its second section 124 forms an energy storage member 126 of the energy storage device 118.

Figure 4A:
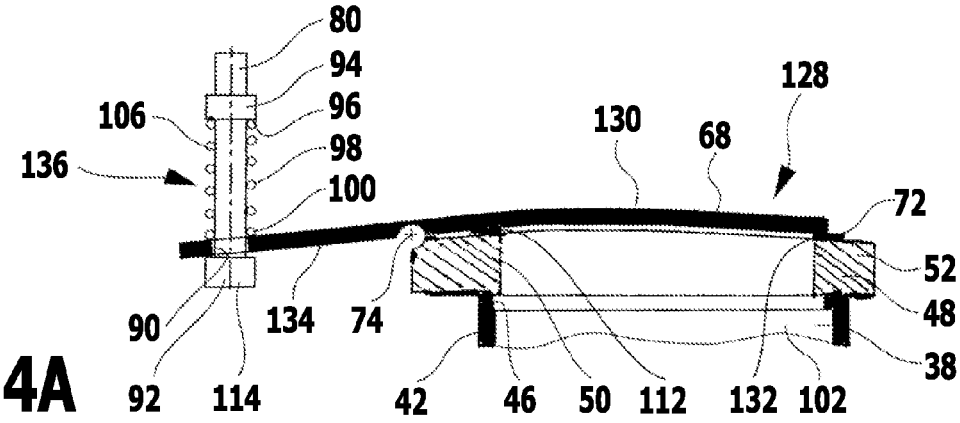
FIG. 4A shows a representation similar to FIG. 2A in a second variant of the suction appliance from FIG. 1.
Figure 4B:
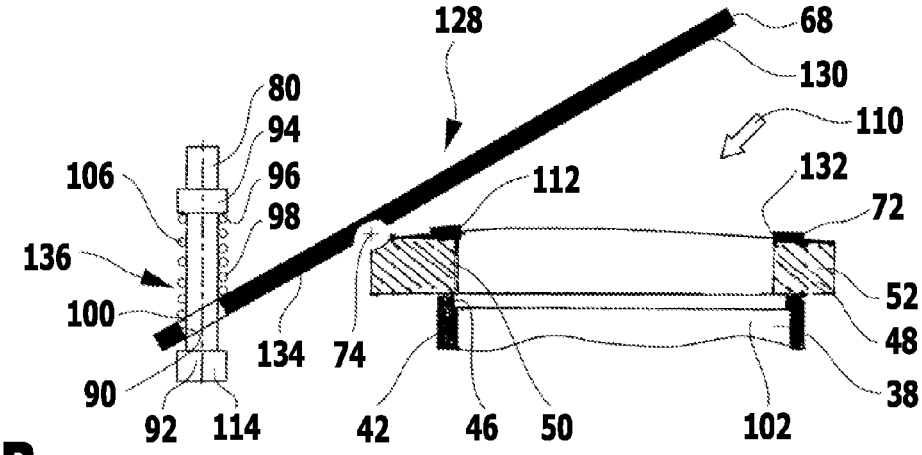
FIG. 4B shows a representation similar to FIG. 2C in the variant of the suction appliance shown in FIG. 4A.

In a further variant of the vacuum cleaner 10, a valve device 128 is used instead of the valve device 64. This is represented, in a manner corresponding to FIGS. 2A and 2C, in FIGS. 4A and 4B, which show a corresponding valve plate 130 of the valve device 128 in its closed position (FIG. 4A) and in its open position (FIG. 4B). Instead of valve seat 66, the valve device 128 comprises a valve seat 132, which forms an arched sealing surface which is of concave configuration relative to the suction chamber 102 and of convex configuration relative to the valve plate 130.

The valve plate 130 is of elastically deformable configuration. It thus forms, as described above, an energy storage member 134 of an energy storage device 136, which, in this variant of the vacuum cleaner 10, is used instead of the energy storage device 108. As in the case of the energy storage device 118, when the actuating member 76 is acted upon with an actuating force, the valve plate 130 can thus absorb work performed on the actuating member 76 in the form of potential energy and release it for rapid opening of the external air inlet 112.

The arched sealing surface of the valve seat 132 has the advantage that the valve plate 130 releases the valve seat 132 uniformly over the entire abutment element 48, i.e., at the same point in time, and, in this way, an even better opening of the external air inlet 112 can be brought about. This results in an even more intensive pressure surge acting upon the filter 34, which, in this way, can be cleaned particularly effectively.

In a further variant of the vacuum cleaner 10, a valve device 138 is used instead of the valve device 64, an energy storage device 140 instead of the energy storage device 108, and a ram 142 instead of the ram 80. In a manner corresponding to FIGS. 2A to 2C, this variant is represented in FIGS. 5A to 5C during transfer of a corresponding valve plate 144 of the valve device 138 from the closed position to the open position by the actuating member 76 being acted upon with an actuating force.

The valve plate 144 is of elastically deformable configuration and comprises a central opening 146. Owing to its elastic deformability, the valve plate 144 forms an energy storage member 148 of the energy storage device 140, which can intermediately store energy supplied to it in the form of potential energy, as was described with reference to the example of the variants of the vacuum cleaner 10 explained above.

The ram 142 passes through the central through-opening 146 and comprises at its free end extending into the suction chamber 102 a head 150 which forms an abutment element 152 for a further energy storage member 154 of the energy storage device 140. The energy storage member 154 is configured in the form of an elastically deformable helical spring 156, which abuts on the abutment element 152 and, for its part, forms an abutment element 158 in the form of a winding abutting on the border of the through-opening 146.

Figure 5A:
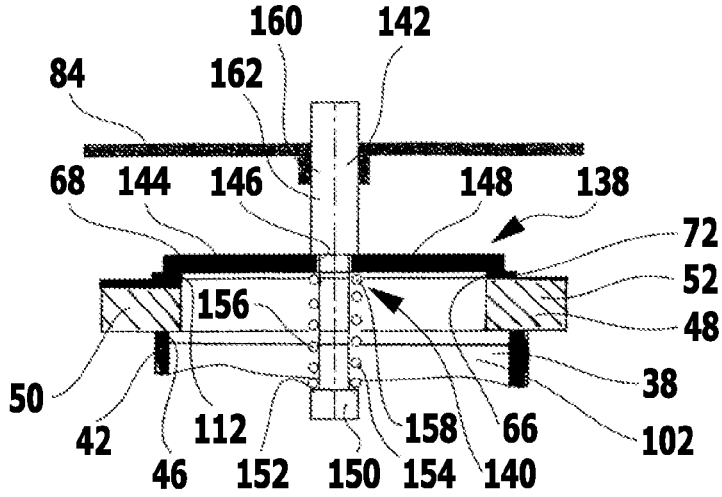
FIG. 5A shows a representation similar to FIG. 2A in a third variant of the suction appliance from FIG. 1.
Figure 5B:
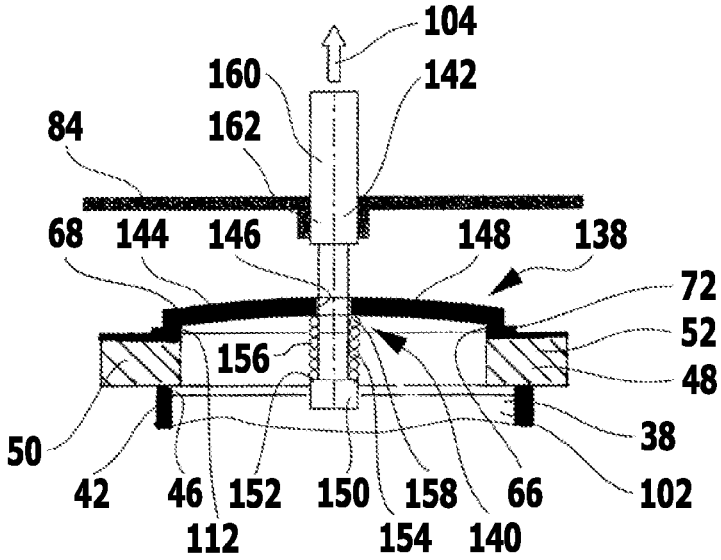
FIG. 5B shows a representation similar to FIG. 2B in the variant of the suction appliance shown in FIG. 5A.
Figure 5C:
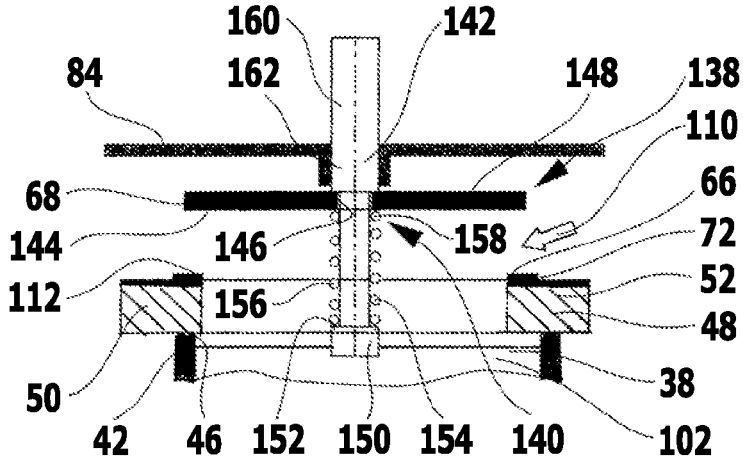
FIG. 5C shows a representation similar to FIG. 2C in the variant of the suction appliance shown in FIG. 5A.

Above the valve plate 144, the ram 142 comprises a thickened section 160, which passes through the tub-shaped supporting part 84 also shown partially in FIGS. 5A to 5C.

In the closed position, the valve plate 144 abuts sealingly on the valve seat 66. It also abuts on the helical spring 156 and on the thickened section 160 of the ram 142 (FIG. 5A). By acting upon the actuating member 76 and thus, in particular, upon the ram 142 with an actuating force in a direction facing away from the cover wall 54, work is performed on the ram 142 by it being displaced relative to the vacuum cleaner 10. This work can be used for compression of the helical spring 156, which abuts on the abutment element 152 of the head 150, in order to transfer the helical spring 156 to an energy storing state in which it stores potential energy. Because the helical spring 156 abuts via the abutment element 158 on the valve plate 144, the deformable valve plate 144 can, for its part, also be elastically deformed and assume an energy storing state, in order to store potential energy (FIG. 5B).

If the potential energy stored intermediately in the helical spring 156 and in the valve plate 144 is sufficient to transfer the valve plate 144 counter to the suction force from the closed position to the open position, it can be released within a very short time, and the valve plate 144 springs from the closed position to the open position in order to release the valve seat 66 (FIG. 5C). In this case, the thickened section 160 of the ram 142 serves as stop member 162 for the valve plate 144 to limit its range of movement. As in the case of the variants explained above, external air can flow into the suction chamber 102 through the external air inlet 112. Because the valve plate 144 is transferred from the closed position to the open position within a short time, in this variant, too, an intensive pressure surge can form, which acts upon the filter 34.

Figure 6:
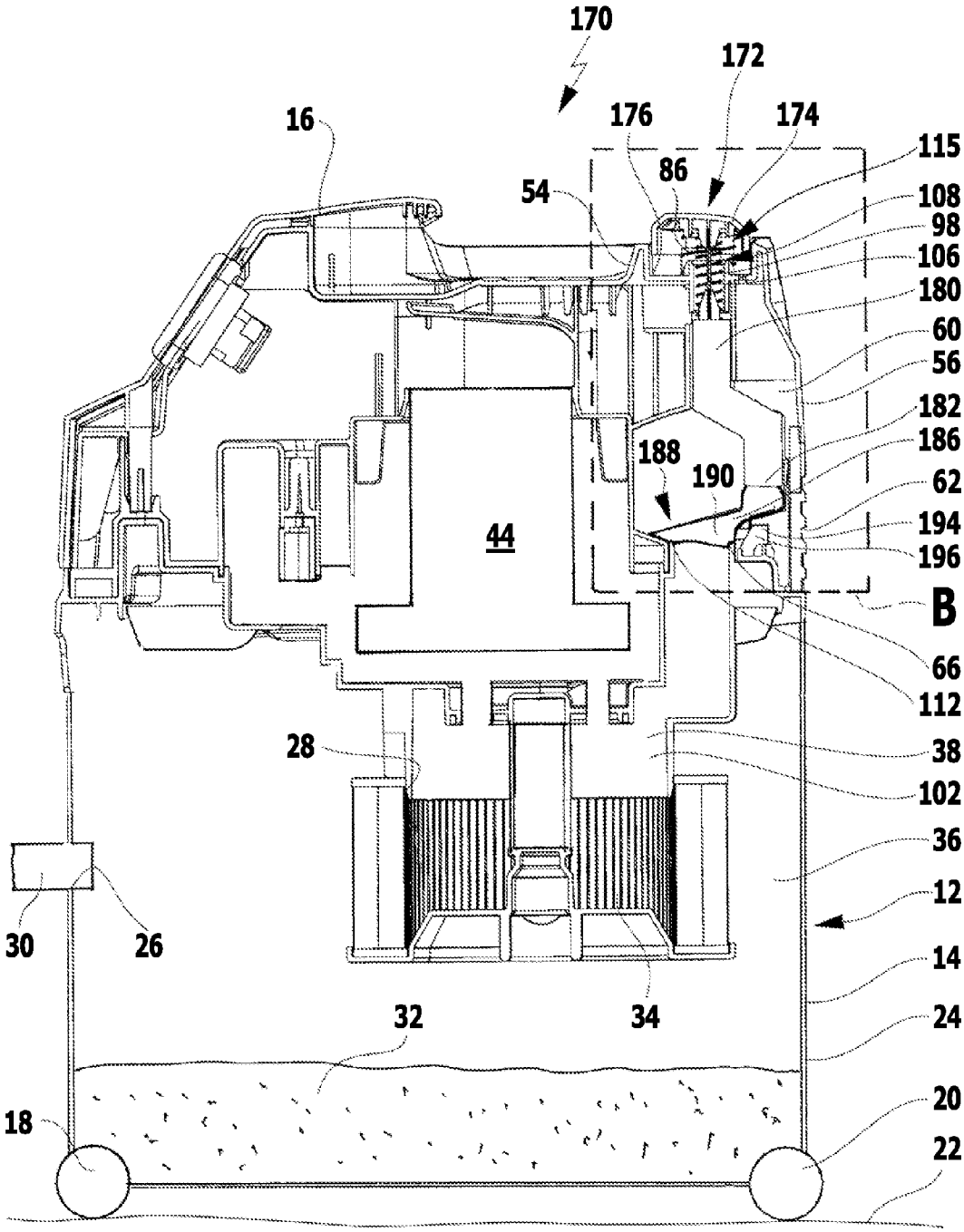
FIG. 6 shows a diagrammatic sectional view of a second preferred embodiment of a suction appliance in accordance with the invention.

A further preferred embodiment of a suction appliance in accordance with the invention, also configured as vacuum cleaner, is shown in a diagrammatic sectional view in FIG. 6 and denoted in its entirety therein by reference numeral 170. Features and components of the vacuum cleaner 170, which are identical to or act identically to features and components of the vacuum cleaner 10, are denoted by the same reference numerals. For details of these features and components, reference is made to the above explanations, in order to avoid repetitions. The above-described advantages of the vacuum cleaner 10 can also be achieved with the vacuum cleaner 170.

The vacuum cleaner 170 comprises an actuating member 172 which is configured as an actuating button 174 and is supported via the helical spring 86 on a tub-shaped depression 176 formed in the cover wall 54 of the vacuum cleaner 170. The actuating button 174 forms an abutment element 178 for the helical spring 98. The helical spring 98 forms, for its part, at its side facing away from the actuating button 174, the abutment element 100, via which it abuts on an angled ram 180.

Figure 7:
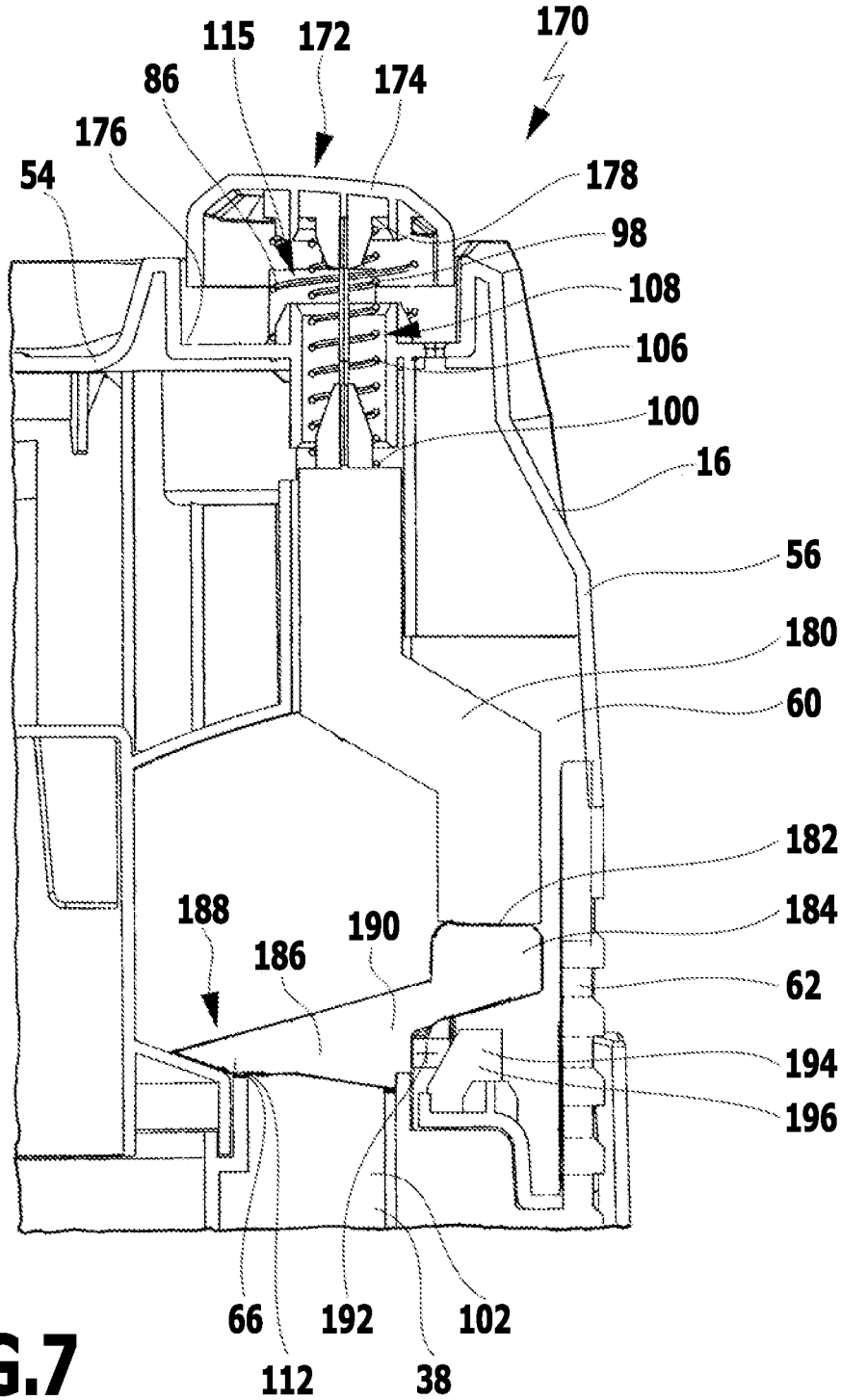
FIG. 7 shows an enlarged representation of detail B in FIG. 6.

The angled ram 180 extends in the vertical direction and abuts with its free end 182 that faces away from the helical spring 98 on a frustoconical section 184 of a valve body 186. The valve body 186 forms together with the valve seat 66 a valve device 188 of the vacuum cleaner 170. The valve body 186 takes the form of a rigid valve flap 190 formed from a plastics material, which is mounted on the vacuum cleaner 170 for pivotal movement about a horizontally extending axis 192 (FIG. 7). In the representation shown in FIGS. 6 and 7, the valve flap 190 assumes its closed position in which it abuts sealingly on the valve seat 66.

By acting upon the actuating member 172, in particular, the actuating button 174, with an actuating force directed into the interior of the vacuum cleaner 170, work can be performed on the actuating button 174. This work can be supplied to the helical spring 98 because it abuts via the abutment element 178 on the actuating button 174. In this way, the helical spring 98 is elastically deformed and can assume an energy storing state in which it intermediately stores energy in the form of potential energy.

If the energy stored by the helical spring 98 is great enough for a suction force acting on the valve flap 190 to be overcome, the potential energy can be released by the helical spring 98 within a short time and given off to the ram 180 via the abutment element 100. This causes the ram 180, which is mounted for sliding displacement on the vacuum cleaner 170, to be displaced in the vertical direction. The ram 180 acts in this way as energy transfer member to give off the energy released by the helical spring 98 to the valve flap 190 and to act upon the valve flap 190 with an opening force. This opening force results in the valve flap 190 being pivoted about the axis 192 and thus abruptly releasing the valve seat 66. As explained above, external air under atmospheric pressure present in the external air space 60 can, in this way, enter the suction chamber 102, which results in an intensive pressure surge acting upon the filter 34. Owing to the rapid opening of the valve flap 190, an intensive pressure surge also occurs in the vacuum cleaner 170, as in the case of the vacuum cleaner 10, and, consequently, an effective cleaning of the filter 34 takes place. A projection 196 formed on the housing 12 of the vacuum cleaner 170 serves as stop member 194 for the valve flap 190 during transfer from the closed position to the open position.

The invention claimed is:

1. Suction appliance for cleaning purposes, in particular, for cleaning floors, comprising:

a dirt collecting container with a suction inlet and a suction outlet on which a filter is held;

a suction unit for acting upon the dirt collecting container with negative pressure;

a suction chamber between the suction unit and the filter with an external air inlet, via which external air can flow into the suction chamber to act upon the filter on the clean-space side;

a valve device with a valve seat forming the external air inlet, and a valve body movable relative to the valve seat, the valve body in a closed position abutting sealingly on the valve seat and in an open position releasing the valve seat; and an actuating member, actuation of which causes the valve body to be transferred from the closed position to the open position;

wherein the suction appliance comprises an energy storage device, which is adapted for energy that is to be stored to be supplied thereto by actuating the actuating member and for stored energy to be released therefrom for transferring the valve body from the closed position to the open position.

2. Suction appliance in accordance with claim 1, wherein the energy storage device is adapted to give off stored energy to the valve body to transfer it from the closed position to the open position.

3. Suction appliance in accordance with claim 1, wherein the energy storage device is adapted for energy to be supplied thereto by a user acting upon the actuating member with an actuating force.

4. Suction appliance in accordance with claim 1, wherein the actuating member is mounted so as to be movable on the suction appliance.

5. Suction appliance in accordance with claim 4, wherein the actuating member is mounted so as to be slidingly displaceable on the suction appliance.

6. Suction appliance in accordance with claim 4, wherein the suction appliance defines a guide for movable mounting of the actuating member.

7. Suction appliance in accordance with claim 1, wherein the actuating member comprises an abutment element for abutment on the energy storage device at least when the actuating member is actuated.

8. Suction appliance in accordance with claim 1, wherein the energy storage device comprises at least one elastically deformable energy storage member.

9. Suction appliance in accordance with claim 8, wherein the at least one energy storage member is configured as a spring.

10. Suction appliance in accordance with claim 8, wherein the at least one energy storage member comprises an abutment element for abutment on the valve body at least when the valve body is transferred from the closed position to the open position.

11. Suction appliance in accordance with claim 1, wherein the energy storage device forms an elastically deformable section of the valve body.

12. Suction appliance in accordance with claim 11, wherein the valve body comprises a first rigid section which in the closed position abuts sealingly on the valve seat, and a second section which forms the elastically deformable section.

13. Suction appliance in accordance with claim 1, wherein the valve body is mounted so as to be movable on the suction appliance.

14. Suction appliance in accordance with claim 13, wherein the suction appliance defines a guide for movable mounting of the valve body.

15. Suction appliance in accordance with claim 13, wherein the valve body is mounted so as to be pivotable on the suction appliance.

16. Suction appliance in accordance with claim 15, wherein the valve body forms a lever with a first section forming a first lever arm which in the closed position abuts on the valve seat, and a second section forming a second lever arm which is adapted to be acted upon with the energy given off by the energy storage device.

17. Suction appliance in accordance with claim 1, wherein the suction appliance has a stop member which is associated with the valve body for limiting its range of movement during transfer from the closed position to the open position.

18. Suction appliance in accordance with claim 1, wherein at least a section of the valve body is plate-shaped.

19. Suction appliance in accordance with claim 1, wherein the valve seat forms an arched sealing surface.

20. Suction appliance in accordance with claim 1, wherein the valve body is configured as a single piece.

21. Suction appliance in accordance with claim 1, wherein a sealing element is arranged between the valve body and the valve seat when the valve body is in the closed position.

22. Suction appliance in accordance with claim 1, wherein the suction appliance comprises a first restoring device for transferring the valve body from the open position to the closed position.

23. Suction appliance in accordance with claim 1, wherein the suction appliance comprises a second restoring device for transferring the actuating member from an actuating position in which it is possible for energy to be supplied to the energy storage device to a position of rest in which it is not possible for energy to be supplied to the energy storage device.

24. Suction appliance in accordance with claim 1, wherein the suction appliance is configured as vacuum cleaner.

* * * * *